US010617161B2

(12) United States Patent
Walrich et al.

(10) Patent No.: US 10,617,161 B2
(45) Date of Patent: Apr. 14, 2020

(54) GARMENTS FOR HEALTHCARE WORKERS

(71) Applicant: Medline Industries, Inc., Mundelein, IL (US)

(72) Inventors: Jennifer A Walrich, Wildwood, IL (US); Michael Pope, Calera, AL (US)

(73) Assignee: MEDLINE INDUSTRIES, INC., Mundelein, IL (US)

( * ) Notice: Subject to any disclaimer, the term of this patent is extended or adjusted under 35 U.S.C. 154(b) by 1528 days.

(21) Appl. No.: 13/745,961

(22) Filed: Jan. 21, 2013

(65) Prior Publication Data

US 2013/0305426 A1 Nov. 21, 2013

Related U.S. Application Data

(63) Continuation-in-part of application No. 13/370,179, filed on Feb. 9, 2012, now Pat. No. 10,258,096, and a continuation-in-part of application No. 29/413,019, filed on Feb. 9, 2012, now Pat. No. Des. 681,915.

(51) Int. Cl.

| | |
|---|---|
| ***A41D 13/12*** | (2006.01) |
| ***A41D 15/00*** | (2006.01) |
| ***A41D 27/10*** | (2006.01) |
| ***A41D 27/24*** | (2006.01) |

(52) U.S. Cl.
CPC ..... *A41D 13/1209* (2013.01); *A41D 15/005* (2013.01); *A41D 27/10* (2013.01); *A41D 27/24* (2013.01)

(58) Field of Classification Search
CPC ..... A61K 2300/00; A61K 31/4178; A61K 45/06; A61K 31/505; A61K 31/513; A61K 31/52; A61K 31/536; A61K 31/551; A61K 31/675; A61K 31/7068; A61K 33/24; A61K 2039/5252; A61K 2039/53; A61K 2039/552; A61K 2039/555; A61K 2039/55555; A41D 13/1209; A41D 15/005; A41D 27/10; A41D 27/24
USPC ..... 2/93, 114, 247, 106, 115, 90, 69
See application file for complete search history.

(56) References Cited

U.S. PATENT DOCUMENTS

| | | | | |
|---|---|---|---|---|
| 1,951,437 | A | 3/1934 | Parfitt | |
| 2,914,773 | A | 12/1959 | Walter | |
| D373,893 | S * | 9/1996 | Patel | D2/840 |
| 5,561,860 | A | 10/1996 | Nguyen-Senderowicz | |
| 5,652,961 | A * | 8/1997 | Knight-Yurt | 2/114 |

(Continued)

OTHER PUBLICATIONS

European Patent Office, Communication with extended European search report, in application No. 13154849.7-1705, dated Jun. 21, 2013. 6 pages.

(Continued)

*Primary Examiner* — Alissa J Tompkins
*Assistant Examiner* — Catherine M Ferreira
(74) *Attorney, Agent, or Firm* — McAndrews, Held & Malloy, Ltd.

(57) ABSTRACT

According to techniques of this application, a garment may include a trunk, three left sleeves, and three right sleeves. Two of the left sleeves and two of the right sleeves may be short sleeves. The third left sleeve and the third right sleeve may be long sleeves. The garment may include a placket that comprises a first placket piece, a second placket piece, and a third placket piece portion. The placket may be assembled separately and then attached to a V-neck cutaway of the trunk.

17 Claims, 7 Drawing Sheets

(56) References Cited

U.S. PATENT DOCUMENTS

| | | | | |
|---|---|---|---|---|
| 5,673,433 | A * | 10/1997 | Rothrum | 2/46 |
| 5,681,860 | A * | 10/1997 | Fisher et al. | 514/629 |
| 6,408,438 | B1 | 7/2002 | McKee | |
| 6,460,187 | B1 | 10/2002 | Siegel | |
| D474,323 | S | 5/2003 | Carter | |
| D476,137 | S | 6/2003 | McFarlane | |
| 7,117,539 | B1 | 10/2006 | Baacke | |
| 7,441,281 | B2 * | 10/2008 | Salem | 2/115 |
| D627,137 | S | 11/2010 | Keavey | |
| D628,360 | S | 12/2010 | Deacon | |
| 8,276,216 | B2 * | 10/2012 | Carney | 2/311 |
| 2004/0064869 | A1 * | 4/2004 | Deadwyler | 2/115 |
| 2005/0044604 | A1 | 3/2005 | Salem | |
| 2006/0025039 | A1 | 2/2006 | Barbour | |
| 2006/0143777 | A1 * | 7/2006 | Dennis et al. | 2/114 |
| 2006/0218693 | A1 * | 10/2006 | Sinohui, Jr. | 2/115 |
| 2010/0017933 | A1 | 1/2010 | Taylor-Barry | |
| 2010/0024088 | A1 | 2/2010 | Griefer | |
| 2011/0239349 | A1 | 10/2011 | Thompson | |
| 2013/0205467 | A1 | 8/2013 | Walrich | |

OTHER PUBLICATIONS

PCT, Notification of Transmittal of the International Search Report and the Written Opinion of the International Searching Authority, or the Declaration, in International application No. PCT/US2014/012304, dated May 14, 2014 (12 pages).

PCT, Notification Concerning Transmittal of International Preliminary Report on Patentability, in Application No. PCT/US2014/012304, dated Jul. 30, 2015 (5 pages).

Canadian Intellectual Property Office, Office Action in Application No. 2,805,520, dated Apr. 16, 2015 (6 pages).

European Patent Office, Communication with extended European search report, in application No. 15181243.5, dated Nov. 3, 2015 (4 pages).

* cited by examiner

GARMENTS FOR HEALTHCARE WORKERS

RELATED APPLICATIONS

This application is a continuation-in-part application of U.S. patent application Ser. No. 13/370,179 filed on Feb. 9, 2012, and is a continuation-in-part application of U.S. patent application Ser. No. 29/413,019, filed on Feb. 9, 2012, the entireties of which are herein incorporated by reference.

FEDERALLY SPONSORED RESEARCH OR DEVELOPMENT

[Not Applicable]

JOINT RESEARCH AGREEMENT

[Not Applicable]

SEQUENCE LISTING

[Not Applicable]

BACKGROUND OF THE INVENTION

Generally, techniques of this application relate to garments worn by healthcare workers, such as doctors, nurses, medics, or other clinical personnel.

One type of garment often worn by healthcare workers is commonly known as a "scrub." In addition to serving as a type of uniform for healthcare workers, garment may be worn for clinical reasons. For example, a garment may provide a barrier to the transmission of undesirable or infectious microbes (for example, bacteria) between a healthcare worker and a patient. A long-sleeved garment (as compared to a short-sleeved garment) may be more effective at providing a barrier around the worker's arms.

Long-sleeved scrub jackets may be worn over a scrub and may have a knit cuff that fits relatively tightly around the wrist. Such a jacket may provide a physical barrier between portions of a healthcare worker's body and the patient. The sleeve of the jacket, however, may be loose-fitting and may cause unintended contacts with a patient. In addition, some individuals may find a scrub and jacket uncomfortably hot to wear.

Besides jackets, long-sleeved scrub shirts may also be worn, but such jackets may also have loose-fitting sleeves. Other garments, such as surgical gowns or fleece jackets, may be relatively costly, may lint, or may have other undesirable qualities.

Therefore, it may be useful to provide garments for healthcare workers that may reduce these and other undesirable effects.

Figure 1A:
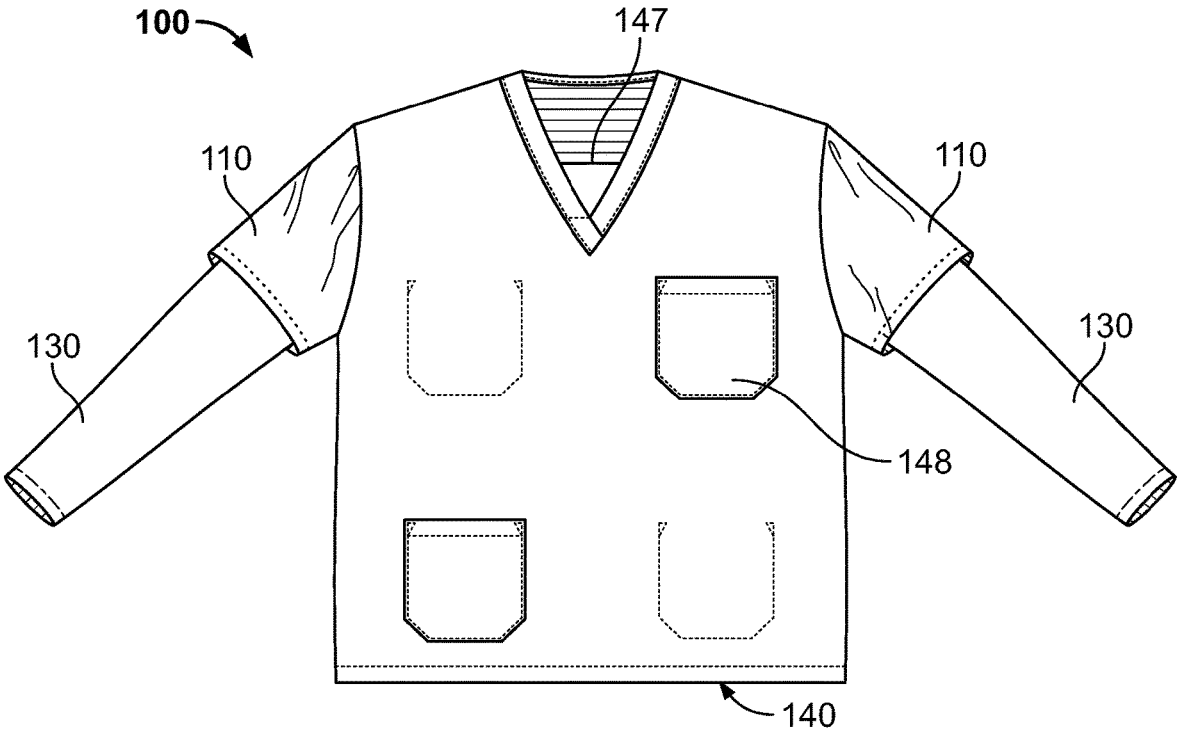
FIGS. 1A and 1B illustrate a garment, according to techniques of the present application.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION OF THE APPLICATION

Figure 1B:
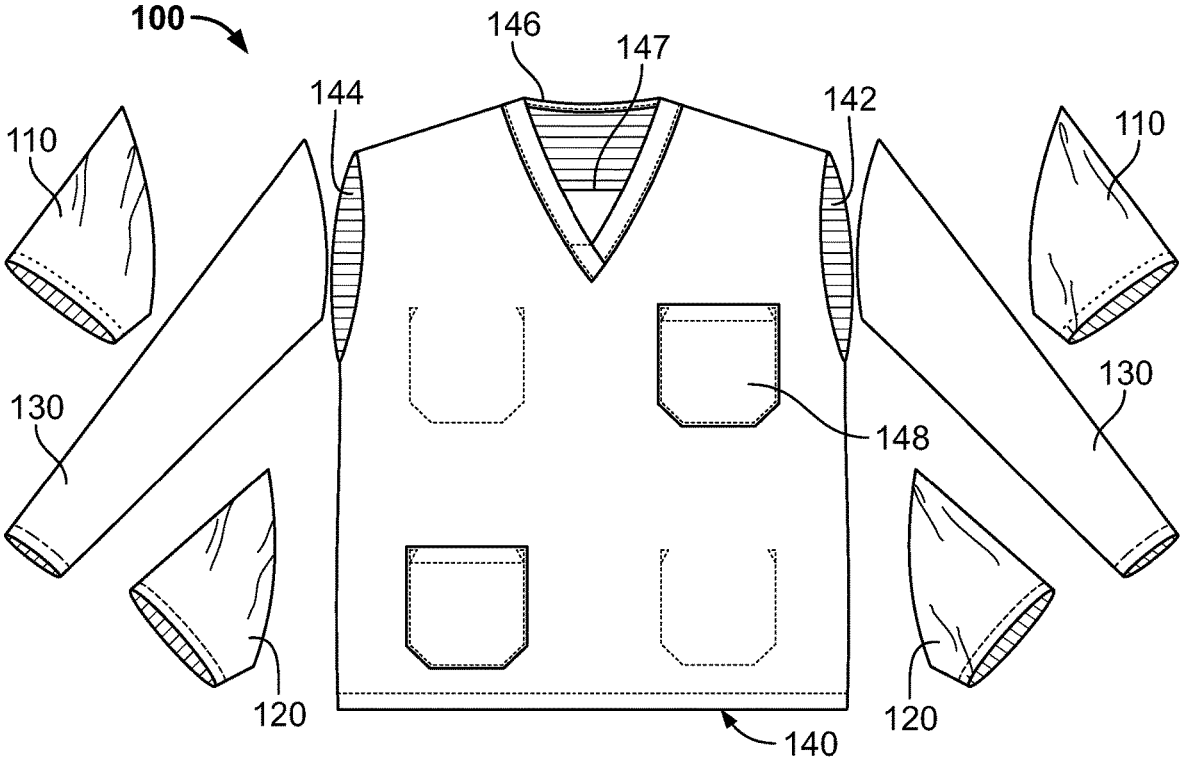

FIGS. 1A and 1B illustrate a garment 100, according to techniques of the present application. The garment 100 may be reversible and may have substantially the same appearance whether outside-out or inside-out. The garment 100 may include a trunk 140 and sleeves 110, 120, and 130. The sleeves 110 and 120 may be short sleeves. The sleeves 130 may be long sleeves. The garment 100 need not include all of these components. For example, the garment 100 may only have one of sleeves 110 or sleeves 120, thereby only having two pairs of sleeves.

A short sleeve may refer to any length of sleeve shorter than another sleeve used in a garment. Similarly, a long sleeve may refer to any length of sleeve longer than another sleeve used in a garment. For example, if a garment has a long sleeve that is a full-length sleeve, then a short sleeve may refer to a traditional short sleeve or a longer sleeve such as a three-quarters-length sleeve. As another example, if a garment has a traditional short sleeve, then a long sleeve may refer to a full-length sleeve or a shorter sleeve such as a three-quarters-length sleeve or a half-length sleeve.

A sleeve may be long or short based on its appearance. For example, a sleeve extension may be attached to a short sleeve. In such a case, the sleeve extension may look like a long sleeve, and therefore may be a long sleeve.

The trunk 140 may include a left arm opening 142, a right arm opening 144, a V-neck cutaway 146, and one or more pockets 148. The trunk 140 may be formed from a loose-fitting fabric, such as a loose-fitting polyester fabric. One example of such a fabric is PerforMAX® made by Medline Industries, Inc. As another example, such fabric may be loose-fitting, woven, and a substantially non-piling synthetic fabric. Such a fabric may have a thread count between T130 to T180. Such a fabric may have a weight between 3 to 6 ounces per square yard ("OSY"). Other types of suitable fabrics may include blends of cotton, polyester, elastane, spandex, rayon, bamboo, recycled polyester, or nylon. Examples of such blends may include the following: 65% polyester/35% cotton, 55% cotton/45% polyester, 100% cotton, 77% polyester/23% Rayon.

The trunk 140 may have pockets 148 on the outside and/or the inside. The trunk 140 may also include a V-neck insert portion 147 that at least partially covers the V-neck cutaway 146. The V-neck insert portion 147 may be attached by a seam to the body of the trunk 140. The V-neck insert portion 147 may include a fabric different from other portions of the trunk. For example, the V-neck insert portion 147 may include a tight-fitting fabric, such as one used to form the sleeves 130, which is discussed in greater detail below.

Each of the sleeves 110 (left sleeve and right sleeve) may have a proximal end 112 and a distal end 114. The sleeves 110 may attach to the trunk 140. The sleeves 110 may be formed from a loose-fitting fabric similar to that used for the trunk 140.

The distal ends 114 of the sleeves 110 may be unattached. The proximal ends 112 may attach at the arm openings 142, 144. Such attachments may be made at the peripheries of the openings 142, 144, for example, with seams. Attachments to the trunk 140 may also be made inside or outside the openings 142, 144. A left-arm seam and a right-arm seam may be used to attach the sleeves 110 to the trunk 140.

Each of the sleeves 120 (left sleeve and right sleeve) may have a proximal end 122 and a distal end 124. The sleeves 120 may attach to the trunk 140. The sleeves 120 may be formed from a loose-fitting fabric similar to that used for the trunk 140.

The distal ends 124 of the sleeves 120 may be unattached. The proximal ends 122 may attach at the arm openings 142, 144. Such attachments may be made at the peripheries of the openings 142, 144, for example, with seams. Attachments to the trunk 140 may also be made inside or outside the openings 142, 144. A left-arm seam and a right-arm seam may be used to attach the sleeves 120 to the trunk 140. A left-arm seam may attach both left sleeve 110 and left sleeve 120 to the trunk 140. A right-arm seam may attach both right sleeve 110 and right sleeve 120 to the trunk 140. As another option, the left sleeves 110, 120 may be attached to the trunk 140 with different seams. Similarly, the right sleeves 110, 120 may be attached to the trunk 140 with different seams.

As another option, the proximal ends 122 of the sleeves 120 may be attached to the sleeves 110. For example, the proximal ends 122 of the sleeves 120 may be attached onto the sleeves 110 near the proximal ends 112.

Each of the sleeves 130 (left sleeve and right sleeve) may have a proximal end 132 and a distal end 134. The sleeves 130 may attach to the trunk 140. The sleeves 110 may be formed from a tight-fitting fabric different from that used for the trunk 140, sleeves 110, or sleeves 120.

A tight-fitting fabric may comprise a fabric having a relatively good stretch memory and/or elasticity. One such fabric that promotes stretch memory and elasticity is spandex. A tight-fitting fabric may have a percentage of a material such as spandex. For example, a tight-fitting fabric may have 10% or more spandex. A tight-fitting fabric may also include other materials, such as polyester or nylon. As an example, a tight-fitting fabric may include 42% polyester, 47% nylon, and 11% spandex. Such a tight fitting fabric may include other suitable blends from materials such as polyester, spandex, nylon, rayon, elastane, lycra, or cotton.

The distal ends 134 of the sleeves 130 may be unattached. The proximal ends 132 may attach at the arm openings 142, 144. Such attachments may be made at the peripheries of the openings 142, 144, for example, with seams. Attachments to the trunk 140 may also be made inside or outside the openings 142, 144. A left-arm seam and a right-arm seam may be used to attach the sleeves 130 to the trunk 140.

A left-arm seam may attach all of the left sleeves 110, 120, 130 to the trunk 140. A right-arm seam may attach all of the right sleeves 110, 120, 130 to the trunk 140. As another option, the left sleeve 130 may be attached to the trunk 140 with a seam different from a seam that attaches the left sleeves 110 or 120. Similarly, the right sleeve 130 may be attached to the trunk 140 with a seam different from a seam that attaches the right sleeves 110 or 120.

As another option, the proximal ends 132 of the sleeves 130 may be attached to one or more of the sleeves 110, 120. For example, the proximal ends 132 of the sleeves 130 may be attached onto the sleeves 110 near the proximal ends 112.

The sleeves 110, 120, and 130 may be arranged concentrically. For example, the sleeves 110 may be the outer sleeves. The sleeves 120 may be the inner sleeves. At least a portion of the sleeves 130 may be sandwiched between the sleeves 110 and 120. As another option, the sleeves 130 may be attached to one or more of the distal ends 114 or 124 of the sleeves 110 or 120. The sleeves 110 and 120 may be short sleeves, while the sleeves 130 may be long sleeves. Therefore, each of the sleeves 130 may have a segment that extends distally from the distal ends of the other sleeves 110 or 120.

The garment 100 may be reversible. If the sleeves 110, 120, and 130 are arranged concentrically and the garment 100 is reversed, the sleeves 110 may become the inner sleeves and the sleeves 120 may become the outer sleeves. At least a portion of the sleeves 130 may still be sandwiched between the sleeves 110 and 120. If the sleeves 110 and 120 are similar in appearance, the garment 100 may appear similar whether the garment 100 is outside-out or inside-out.

As another option, the garment 100 may not be intended to be worn reversibly. For example, the garment 100 may include sleeves 110, but not sleeves 120. As another option, the garment 100 may be intended to be worn reversibly, but the garment 100 may have only the sleeves 130.

Each of the different components of the garment 100 may be formed from a single layer of fabric. It may also be possible to use two or more layers of fabric for one or more of the components. For example, the trunk 140 may have an additional insulating layer to provide for additional warmth. Such a layer may be formed from a loose-fitting or tight-fitting fabric as discussed above. Such a layer may also be formed from other types of fabrics or materials.

Figure 2:
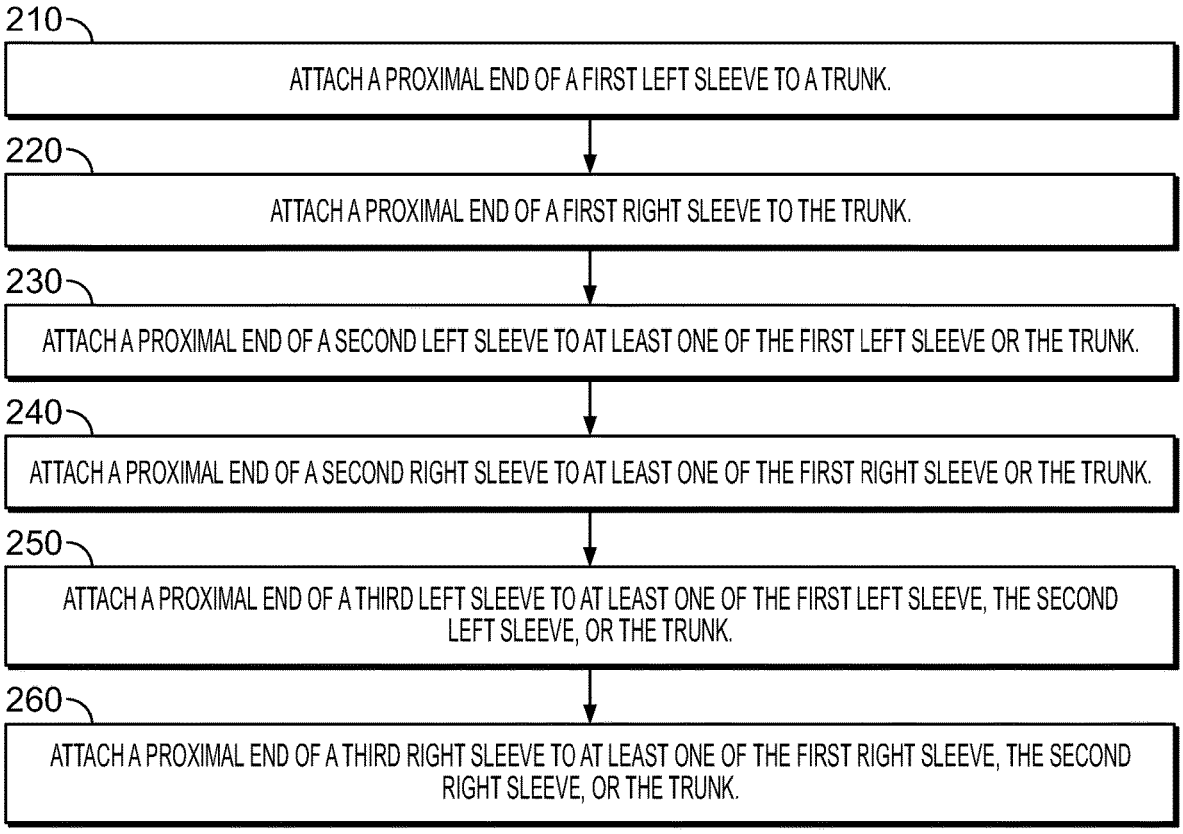
FIG. 2 shows a flowchart of a method for constructing a garment, according to techniques of the present application.
Figure 3A:
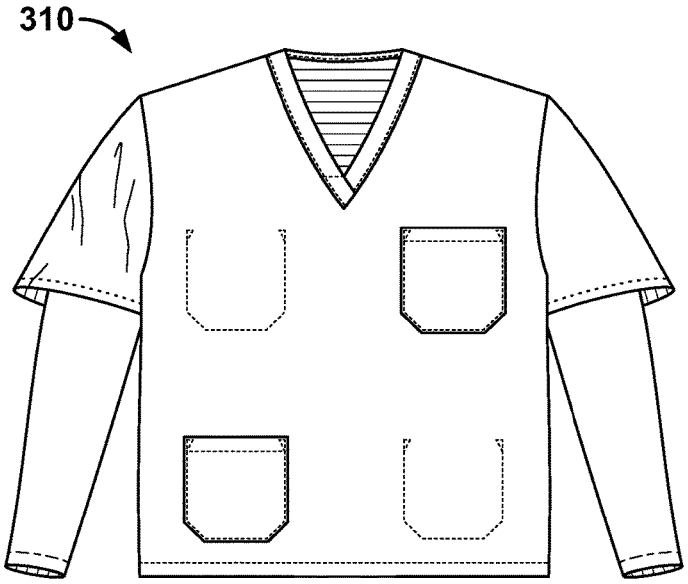
FIGS. 3A-3D illustrate a set of garments, according to techniques of the present application.
Figure 3B:
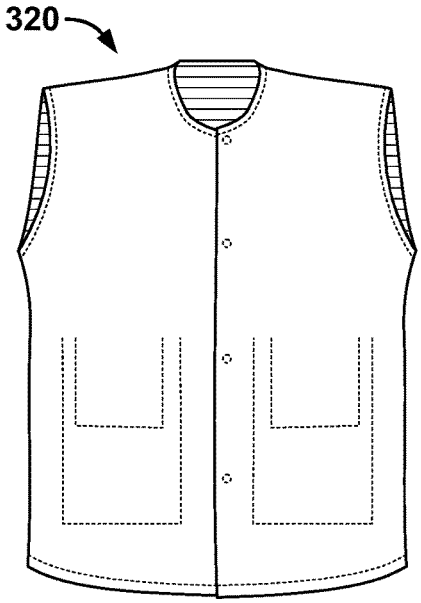
Figure 3C:
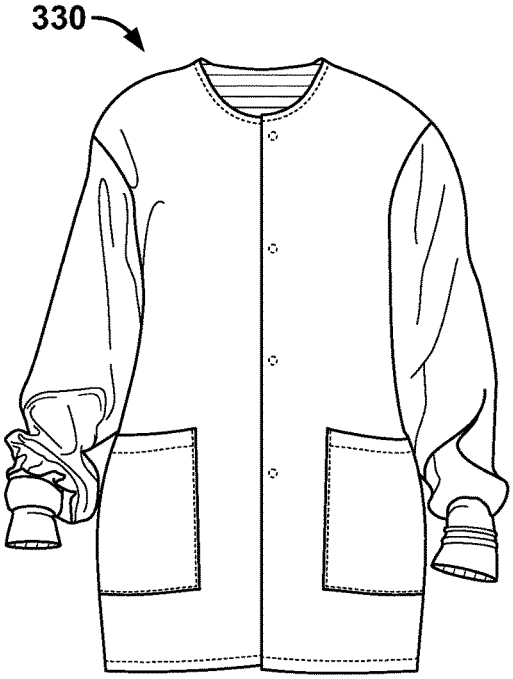
Figure 3D:
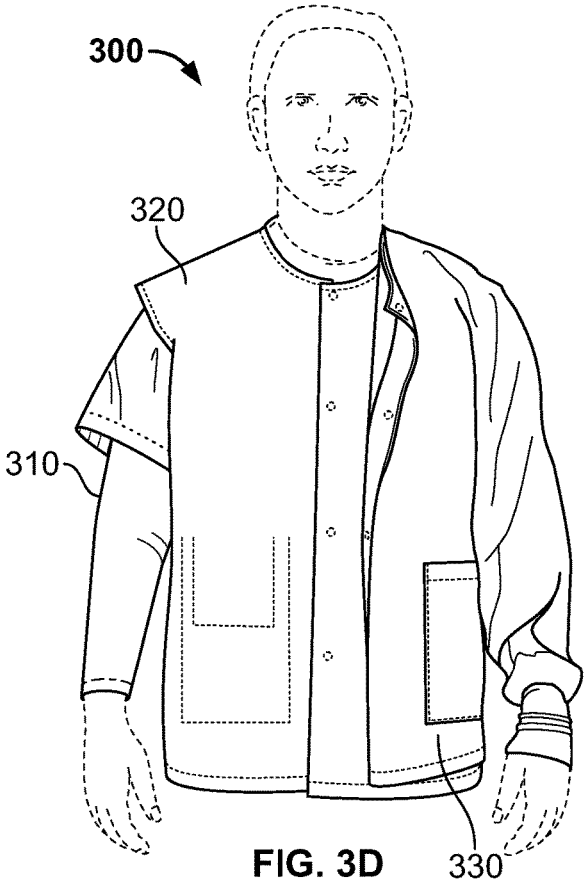

FIG. 2 shows a flowchart 200 of a method for constructing a garment, according to techniques of the present application. The garment may be similar to garment 100. Some of the steps of flowchart 200 may be performable in a different order, performable at the same time or overlapping in time, or omitted according to design or preferences. The steps in flowchart 200 may be performed in conjunction with a sequence such as that shown in FIGS. 4A-4I or by those described in more detail below.

At step 210, a proximal end of a first left sleeve may be attached to a trunk. For example, the proximal end of the first left sleeve may be attached to the trunk by a left arm seam at a left arm opening of the trunk. The technique of attaching a proximal end of a sleeve to the trunk by a seam at an arm opening may encompass attaching the proximal end of a sleeve at the periphery of the arm opening or inside or outside of the arm opening. The first left sleeve may be a short sleeve or may be formed from a loose-fitting fabric (such as the loose-fitting fabrics described above).

At step 220, a proximal end of a first right sleeve may be attached to a trunk. For example, the proximal end of the first right sleeve may be attached to the trunk by a right arm seam at a right arm opening of the trunk. The first right sleeve may be a short sleeve or may be formed from a loose-fitting fabric (such as the loose-fitting fabrics described above).

At step 230, a proximal end of a second left sleeve may be attached to either the trunk or the first left sleeve. For example, the proximal end of the second left sleeve may be attached to the trunk at the left arm opening with the left arm seam used in step 210. The second left sleeve may be a short sleeve or may be formed from a loose-fitting fabric (such as the loose-fitting fabrics described above).

At step 240, a proximal end of a second right sleeve may be attached to either the trunk or the first right sleeve. For example, the proximal end of the second right sleeve may be attached to the trunk at the right arm opening with the right arm seam used in step 220. The second right sleeve may be a short sleeve or may be formed from a loose-fitting fabric (such as the loose-fitting fabrics described above).

At step 250, a proximal end of a third left sleeve may be attached to either one of the first left sleeve, the second left sleeve, or the trunk. For example, the third left sleeve may be attached at the left arm opening of the trunk with the same left seam used in steps 210 and/or step 230. The third left sleeve may be a long sleeve or may be formed from a tight-fitting fabric (such as the tight-fitting fabrics described above).

At step 260, a proximal end of a third right sleeve may be attached to either one of the first right sleeve, the second right sleeve, or the trunk. For example, the third right sleeve may be attached at the right arm opening of the trunk with the same right seam used in steps 220 and/or step 240. The third right sleeve may be a long sleeve or may be formed from a tight-fitting fabric (such as the tight-fitting fabrics described above).

FIGS. 3A-3D illustrate a set of garments 300, according to techniques of the present application. The set 300 may include a base-layer garment 310, a temperature-adjusting vest 320, and a warm-up jacket 330. The base-layer garment 310 may be similar to garment 100.

The temperature-adjusting vest 320 may be arranged to be worn over the base-layer garment. The temperature-adjusting vest 320 may include a non-linting gore fabric such as Resistat®, Blockade™, Gore® fabrics, or the like. A fabric that is "non-linting" may be relatively or substantially resistant to forming lint. The temperature adjusting vest may also include pockets for general storage or to receive one or more temperature-adjusting devices, such as a heating device (for example, a heat pack) or a cooling device (for example, a cold pack). Such pocket(s) may be arranged on the inside or the outside of the vest. The warm-up jacket 330 may be arranged to be worn over the temperature-adjusting vest 320 and the base-layer garment 310.

FIGS. 4A-4I illustrate a sequence for constructing a garment, according to techniques of the present application. For exemplary purposes, the construction process is illustrated using garment 100. Some of the steps of the sequence may be omitted, separated, or combined. Some of the steps may be performed in a different order or at overlapping times while other step(s) are being performed. The construction sequence shown in FIGS. 4A-4F is illustrated with respect to the left side of the garment 100 only. A similar technique, while not depicted in explicit detail, may also be applicable to the right side of the garment 100.

Figure 4A:
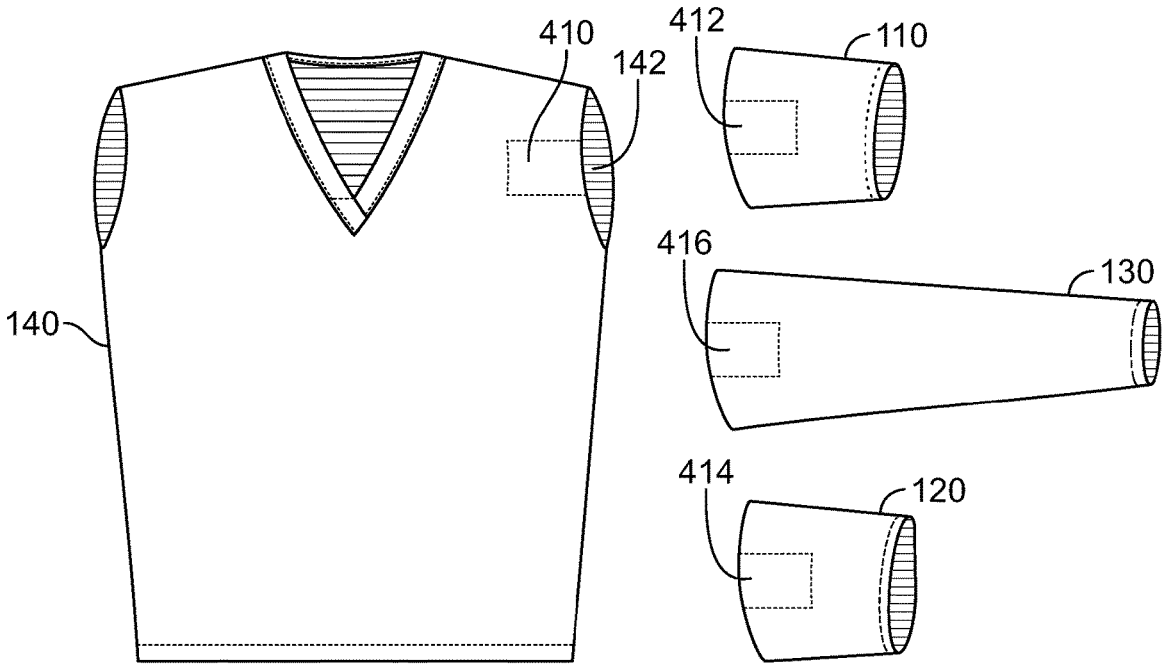
FIGS. 4A-4I illustrate a sequence for constructing a garment, according to techniques of the present application.

Turning to FIG. 4A, the garment 100 is illustrated with its constituent left sleeves. The right sleeves are omitted. For the purpose of clarity, the construction technique is illustrated using four swatches 410, 412, 414, 416 which are shown as being part of the trunk 140, first left sleeve 110, second left sleeve 120, and third left sleeve 130, respectively. Each of the swatches has a face side depicted without fill, and a reverse side depicted with horizontal-line fill (Note, the garment 100 may be reversible and therefore the face sides may become the reverse sides. This point, however, is not directly pertinent to the following description.) To simplify the description of the construction technique, a given swatch can also be referred to by its respective part. Thus, swatch 410 may also be referred to as the trunk 410, swatch 412 as the first left sleeve 412, swatch 414 as the second left sleeve 414, and swatch 416 as the third left sleeve 416.

Figure 4B:
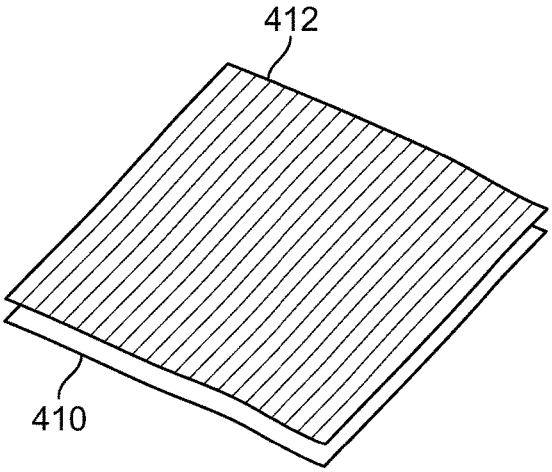
Figure 4C:
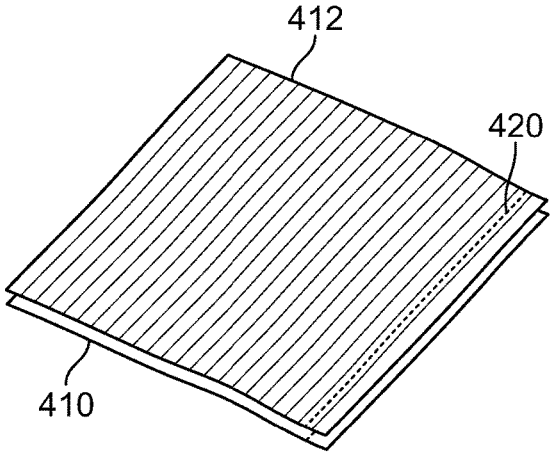
Figure 4D:
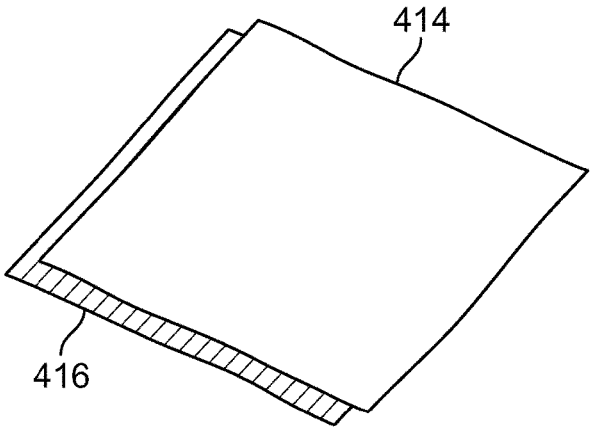
Figure 4E:
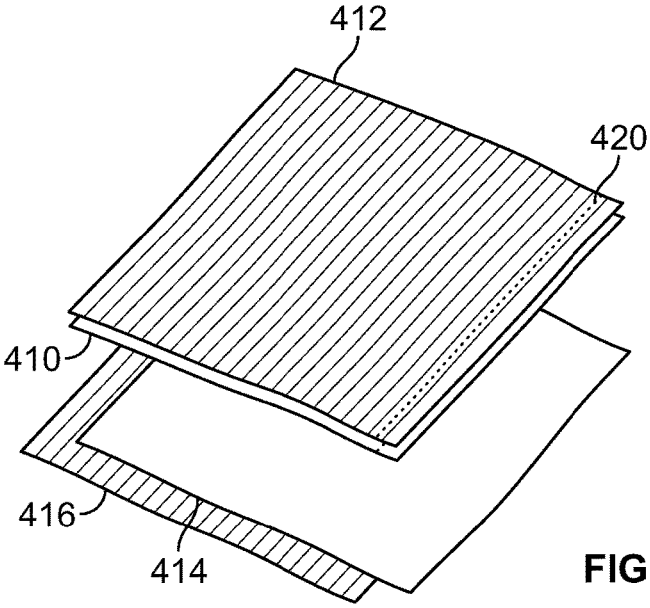

As shown in FIGS. 4B and 4C, the face side of the trunk 410 may be arranged against the face side of the first left sleeve 412. With a stitch 220, the proximal end of the first left sleeve 412 may be attached around the perimeter of the left arm opening 142 of the trunk 410. As shown in FIGS. 4D and 4E, the reverse side of the third left sleeve 416 may be arranged against the reverse side of the second left sleeve 414. The proximal ends of the second left sleeve 416 and third left sleeve 414 may be attached with an additional stitch (not shown). The face side of the second left sleeve 414 may be arranged against the reverse side of the trunk 410.

Figure 4F:
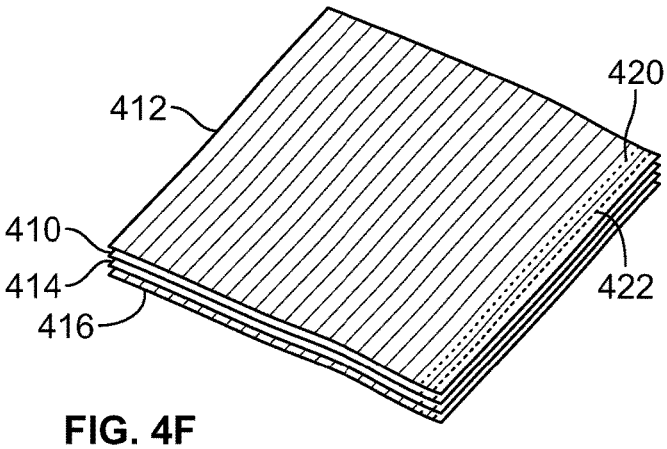
Figure 4G:
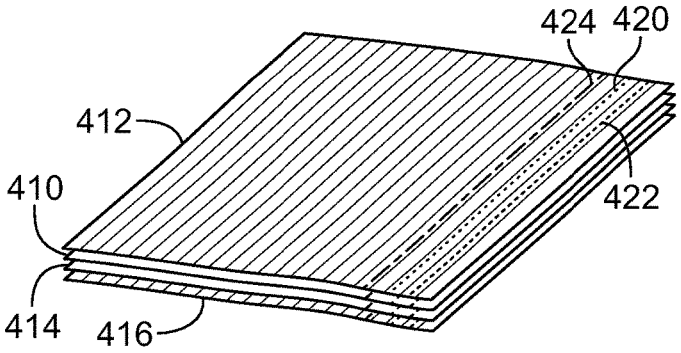

As shown in FIG. 4F, the proximal ends of the first, second, and third left sleeves 412, 416, 414 may be attached with a stitch 422 around the perimeter of the left arm opening 142 of the trunk 410. Optionally, such an attachment may be made with one stitch, rather than two or more stitches (for example, stitch 420, 422, and other stitches not depicted). As shown in FIG. 4G, the proximal ends of the first, second, and third left sleeves 412, 416, 414 may be attached again with a stitch 424 around the perimeter of the left arm opening 142 of the trunk 410. Stitch 424 may be referred to as a guide stitch. Stitch 424 may be helpful for more precise alignment of the left sleeves 412, 414, 416 and the trunk 410.

Figure 4H:
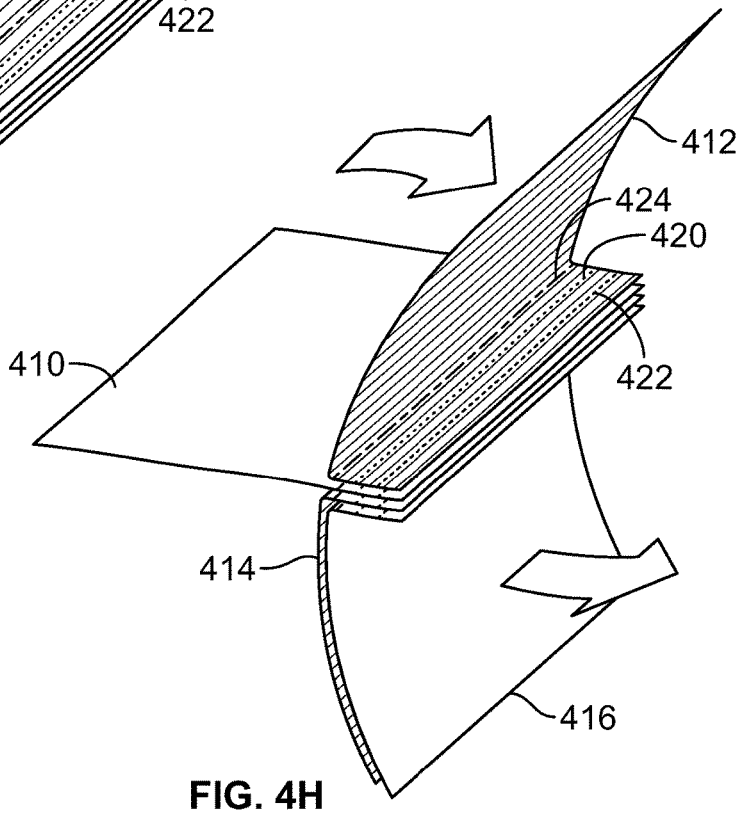

As shown in FIG. 4H, a different arrangement may be formed by folding over the first, second, and third left sleeves 412, 414, and 416. The face side of the third left sleeve 416 may be arranged against the reverse side of the first left sleeve. The reverse side of the second left sleeve 414 and the reverse side of the third left sleeve 416 may maintain their arrangement.

Figure 4I:
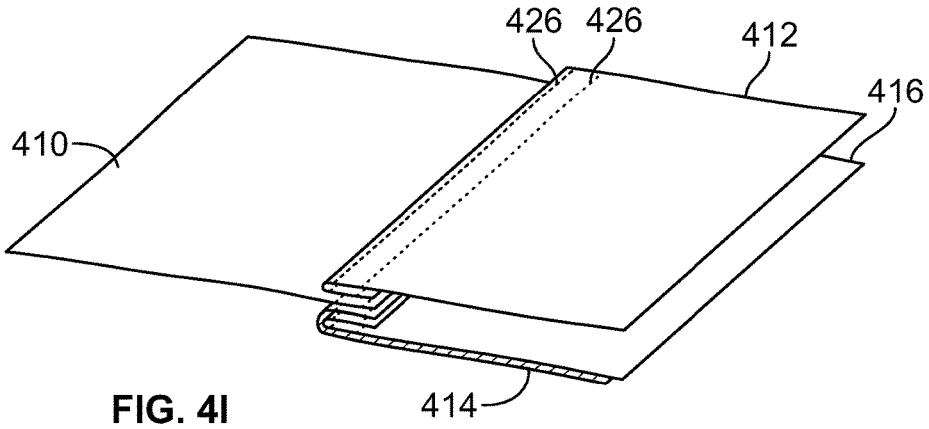

After forming this arrangement, the seams 420, 422, or 424 may be concealed. As shown in FIG. 4I, one or more additional stitches 426 may be used to maintain the new arrangement and/or to provide a decorative effect. If two stitches 426 are used, they may be ¼" apart. They may be formed using a double-needle stitching process.

Again, while FIGS. 4A-4I focus on the left side of the garment, the entire process may be repeated for the right side of the garment.

The construction sequence shown in FIGS. 4A-4I may be achieved or facilitated by a process such as the following one. Some of the portions the process may be omitted, separated, or combined. Some of the performed may be performed in a different order or at overlapping times while other part(s) are being performed.

A portion of the trunk 140 that includes the left arm opening 142 may be inserted through the distal opening of the first left sleeve 110. The left arm hole 142 may be aligned with the proximal opening or end of the first left sleeve 110. A stitch may be used to stitch the proximal end of the first left sleeve 110 together with the trunk 140 around the perimeter of the left arm hole 142.

The proximal end of the second left sleeve 120 may be inserted inside the trunk 140 and through the distal opening of the first left sleeve 110. The proximal end of the third left sleeve 130 may be inserted through the distal opening of the second left sleeve 120. The proximal ends of the second and third left sleeves 120, 130 may optionally be aligned and stitched together.

The left arm hole 142 may be aligned with the proximal openings or ends of the second and third left sleeves 120, 130. All of the parts 110, 120, 130, 140 may be stitched together at the proximal ends of the sleeves 110, 120, 130 and around the perimeter of the left arm hole 142 of the trunk 140. Optionally, instead of performing two or more separate alignment steps and using the previous stitch(s), it may be possible to arrange all of the parts 110, 120, 130, 140 in a desired arrangement and to stitch them together at one time with one or more stitches.

In order to more precisely arrange the parts 110, 120, 130, 140, it may be useful to employ an additional stitch, such as a guide stitch. A guide stitch may be helpful, for example, to provide a clean line around the armhole 142 in preparation for final stitching to finish the garment 100.

Next, the parts 110, 120, 130, 140 may be rearranged. The distal end of the second left sleeve 120 may be inserted through the distal end of the third left sleeve 130. The distal ends of the second and third left sleeves 120, 130 may then be pulled through the left arm hole 142. The trunk may then be pulled through the distal hole of the first left sleeve 110. In this arrangement, the previous stitches may be concealed. One or more additional stitches may be used to stitch the proximal ends of the first, second, and third left sleeves 110, 120, 130 around the perimeter of the left arm hole 142 of the trunk 140.

The process (or at least a portion thereof) may then be repeated for the right side of the garment 100.

As discussed above, the V-neck insert portion 147 may include a tight-fitting fabric (for example, a fabric that includes 10% or more spandex).

Figure 5A:
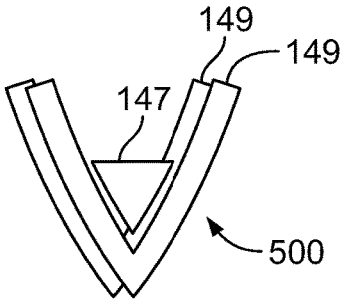
FIGS. 5A-5D illustrate a sequence for constructing a placket, according to techniques of the present application.

FIGS. 5A-5D illustrate a sequence for constructing a placket, according to techniques of the present application. As shown in FIG. 5A, a placket 500 includes first and second placket pieces 149. The first and second placket pieces 149 may be V-shaped pieces. The placket 500 may also include the V-neck insert portion 147, which may also be considered a third placket piece 147. The third placket piece 147 may be located at least partially between the first and second placket pieces 149. The third placket piece 147 may also extend across an open area (for example, a V-neck open area).

Figure 5B:
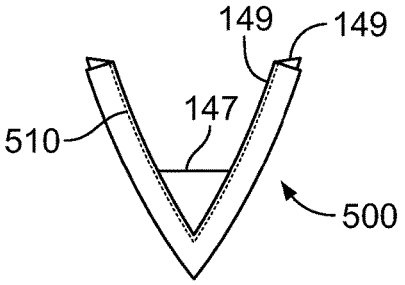
Figure 5C:
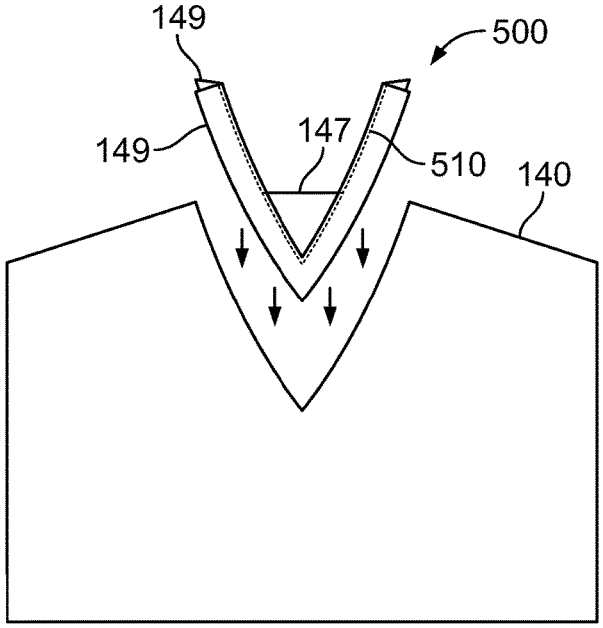
Figure 5D:
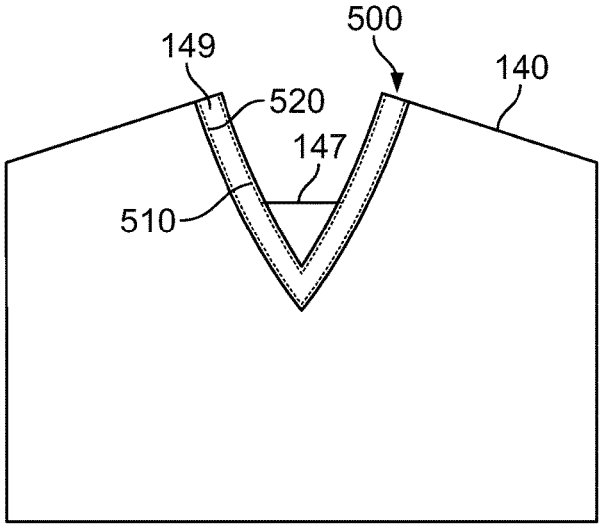

As shown in FIG. 5B, the third placket piece 147 may be attached to the first and second placket pieces by at least one placket inner seam 510. The placket inner seam may also connect the first and second placket pieces 149. As shown in FIG. 5C, the placket 500 may be inserted into at least a portion of a V-neck cutaway in the trunk 140. The placket 500 may be inserted such that a portion of the trunk 140 may be in between the unstitched sides of the first and second placket pieces 149. As shown in FIG. 5D, the placket may be attached to at least a portion of the V-neck cutaway in the trunk 140 with at least one placket outer seam 520.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. A garment comprising:

a placket attached to at least a portion of a V-neck cutaway in a trunk with at least one placket outer seam, wherein the placket includes:

a first placket piece;

a second placket piece attached to the first placket piece by at least one placket inner seam, wherein the first placket piece and the second placket piece form a V-shaped open area comprising a neck opening;

a third placket piece located at least partially between the first placket piece and the second placket piece;

wherein the third placket piece extends across a bottom region of the V-shaped open area; and wherein the third placket piece is attached to the first placket piece and the second placket piece by the at least one placket inner seam.

2. The garment of claim 1, further comprising a short left sleeve, a short right sleeve, a long left sleeve, and a long right sleeve.

3. The garment of claim 2, wherein the garment is reversible.

4. The garment of claim 1, further comprising:

a first left sleeve including an unattached distal end and a proximal end attached to the trunk;

a second left sleeve including an unattached distal end and a proximal end attached to at least one of the trunk or the first left sleeve;

a third left sleeve including a segment extending distally from the distal ends of the first and second left sleeves;

a first right sleeve including an unattached distal end and a proximal end attached to the trunk;

a second right sleeve including an unattached distal end and a proximal end attached to at least one of the trunk or the first right sleeve; and a third right sleeve including a segment extending distally from the distal ends of the first and second right sleeves.

5. The garment of claim 4, wherein each of the first left sleeve, the second left sleeve, the first right sleeve, and the second right sleeve comprises a short sleeve.

6. The garment of claim 5, wherein each of the third left sleeve and the third right sleeve comprises a long sleeve.

7. The garment of claim 4, wherein:

each of the trunk, the first left sleeve, the second left sleeve, the first right sleeve, and the second right sleeve comprises a first type of fabric; and each of the third placket piece, the third left sleeve, and the third right sleeve comprises a second type of fabric different from the first type of fabric.

8. The garment of claim 7, wherein:

the first type of fabric is loose-fitting; and the second type of fabric is tight-fitting.

9. The garment of claim 8, wherein:

the first type of fabric comprises a thread count between T130 to T180 and a weight between 3 to 6 ounces per square yard; and the second type of fabric comprises a material having at least 11% spandex.

10. The garment of claim 4, wherein:

the proximal end of the first left sleeve is attached to the trunk by a left arm seam at a left arm opening of the trunk; and the proximal end of the first right sleeve is attached to the trunk by a right arm seam at a right arm opening of the trunk.

11. The garment of claim 10, wherein:

the proximal end of the second left sleeve is attached to the trunk by the left arm seam at the left arm opening of the trunk; and the proximal end of the second right sleeve is attached to the trunk by the right arm seam at the right arm opening of the trunk.

12. The garment of claim 11, wherein:

a proximal end of the third left sleeve is attached to the trunk by the left arm seam at the left arm opening of the trunk; and a proximal end of the third right sleeve is attached to the trunk by the right arm seam at the right arm opening of the trunk.

13. The garment of claim 4, wherein a front side of the trunk comprises an outer pocket and an inner pocket.

14. The garment of claim 4, wherein each of the trunk, the first left sleeve, the second left sleeve, the first right sleeve, and the second right sleeve comprises a single layer of fabric.

15. The garment of claim 1, wherein the first and second placket pieces comprise V-shaped pieces.

16. A garment comprising:

a trunk having a V-neck cutaway area comprising a neck opening;

a left short sleeve including an unattached distal end and a proximal end attached to the trunk;

a left long sleeve including a segment extending distally from the distal end of the left short sleeve;

a right short sleeve including an unattached distal end and a proximal end attached to the trunk;

a right long sleeve including a segment extending distally from the distal end of the right short sleeve; and a V-neck insert portion covering at least a part of a bottom area of the V-neck cutaway area in the trunk.

17. The garment of claim 16, further comprising:

a placket attached to at least a portion of the V-neck cutaway in a trunk with at least one placket outer seam, wherein the placket includes:

a first placket piece;

a second placket piece attached to the first placket piece by at least one placket inner seam;

a third placket piece including the V-neck insert portion, wherein the third placket piece is located at least partially between the first placket piece and the second placket piece;

wherein the third placket piece extends across an open area defined by the first and second placket pieces; and wherein the third placket piece is attached to the first placket piece and the second placket piece by the at least one placket inner seam.

* * * * *